US005817246A

United States Patent [19]

Flossdorf et al.

[11] Patent Number: 5,817,246

[45] Date of Patent: Oct. 6, 1998

[54] SLIDING GATE

[75] Inventors: Kurt Flossdorf, Hürtgenwald; Heinz Dieter Hannes, Düren; Josef Lothmann, Langerwehe, all of Germany

[73] Assignee: USX Corporation, Pittsburgh, Pa.

[21] Appl. No.: 894,361

[22] PCT Filed: May 20, 1996

[86] PCT No.: PCT/IB96/00687

§ 371 Date: Aug. 20, 1997

§ 102(e) Date: Aug. 20, 1997

[87] PCT Pub. No.: WO96/38686

PCT Pub. Date: Dec. 5, 1996

[30] Foreign Application Priority Data

May 20, 1995 [DE] Germany ..... 195 20 800.5

[51] Int. Cl.[6] ..... B22D 41/08

[52] U.S. Cl. ..... 222/600

[58] Field of Search ..... 222/600, 597; 266/236; 164/437, 337

[56] References Cited

U.S. PATENT DOCUMENTS

| | | | |
|---|---|---|---|
| 4,921,148 | 5/1990 | Muller | 222/600 |
| 5,151,201 | 9/1992 | Fishler et al. | 222/600 |
| 5,518,154 | 5/1996 | Vassilicos et al. | 222/600 |

*Primary Examiner*—Scott Kastler
*Attorney, Agent, or Firm*—William F. Riesmeyer, III

[57] ABSTRACT

A sliding gate valve comprising a chamber (22), a stationary mounted plate (2) and a sliding plate (1) that is movable in relation to said stationary plate, and sliding plate being supported within a slide frame (20) that is movable in relation to the chamber (22), and of spring elements (10) which press the sliding plate against the stationary plate (2). The slide frame (20) has a shape in the form of a trough, of which the upper longitudinal edges (17) protrude laterally outwardly and form slide surfaces (18) that correspond to the slide surfaces (19) of the chamber during operation.

13 Claims, 5 Drawing Sheets

SLIDING GATE

TECHNICAL FIELD

The invention relates to a sliding gate valve comprising a chamber, a stationary refractory plate and a sliding refractory plate movable in relation to said stationary plate, said sliding plate being supported within a slide frame that is movable in relation to the chamber, said sliding plate being pressed by means of spring elements against the stationary plate.

Sliding valves of this type are well known. Reference is made, purely for example, to U.S. Pat. No. 4,063,668.

BACKGROUND ART

In this regard, FIG. 5, shows a longitudinal section of part of a conventional slide gate valve for ladles. This pouring ladle valve is characterized by a mounting plate 1 attached to the lower side of the casting vessel which is not explained in any further detail, an interchangeable ring 34 of a refractory within said mounting plate, a sliding chamber 2 , a slide frame 5 as well as a stationary refractory top plate 39 and a sliding refractory valve plate 40 that is movable in relation to said stationary top plate. The sliding chamber 2 is contained by side walls 6and a floor plate 3 . The slide frame 5 comprises a plate 8 extending parallel to the sliding valve plate 40 and having sleeve-like insert pockets 9 for the insertion of thermodynamic spring elements 10 which are supported on the one hand by the lower side of the sliding valve plate 40 and on the other hand by the floor plate 4 of the slide frame 5 with sufficient pressure of the sliding valve plate 40 against the top plate 39 . On the sliding-plate-side of the floor plate 4 of the slide frame 5, the spring elements 10 are provided with pot-like recesses 12 into which an axial continuation of spring elements 10 can extend. Spring elements 10 are supported on the upper edge of the recesses 12 by means of a supporting plate 13.

The supporting plate can be swung round together with the chamber 2 and the slide frame 5 opposite to the top plate 39. The lock attachment associated with this swinging mechanism is marked as no. 11 in FIG. 5.

A heat insulating shield 7 also extends below the chamber 2.

The slide frame 5 is arranged within the chamber 2 so as to allow for longitudinal movement. For this purpose the floor plate 3 of the chamber 2 includes ribbon-like slide rails 14 on the inside, while the floor plate 4 of the slide frame 5 has also ribbon-like slide rails 15 on the outside or its lower side. These two slide rails 14, 15 also define a narrow gap 16 between the lower side of the floor plate 4of the slide frame 5 and the inner or upper side of the floor plate 3 of the chamber 2.

Practical use has shown that the refractory, in particular that of the sliding valve plate, leaks tar constituents during operation which drop down within the slide frame and the chamber. This causes the pockets 9 for the insertion of the thermodynamic spring elements 10 to clog up. The slide surfaces defined by the slide rails 14, 15also become clogged. The slide rails 14, 15 are normally made of bronze. The tar is deposited here and causes the slide surfaces to become sticky. As a result, the slide frame 5 can no longer be moved back and forth smoothly. The sliding gate valve thereby loses its precision with extended operation.

DISCLOSURE OF THE INVENTION

One aspect of this invention is the fact that the slide surfaces are located outside of the area that is susceptible to clogging. This ensures continuous and precise operation.

Preferably the slide frame is designed in one piece, wherein the floor defines a type of segment grid. This makes it unnecessary to have a separate floor plate for the slide frame as well as for the chamber. Due to the floor apertures formed by the segment grid, the tar originating at the sliding valve plate can drop below without clogging any sliding parts, in particular displaced parts. The same is true if the floor is defined by the supporting segments or plates associated with the spring elements, but otherwise has the same open design.

A second aspect of the invention is that the spring elements may be easily inserted and removed, on the one hand, and in particular be replaced as a single component unit on the other hand. This means that the layout of the spring elements can be easily changed by using perforated plates with a different arrangement of holes for the spring elements. In contrast to the state-of-the-art, there are no clogging-intensive insert pockets for the spring elements and no supporting plates for their support on the floor plate of the slide frame. This function may preferably be accomplished where the spring elements are positioned in such a way that they are supported by the intersection of the slide-frame segments defining a grid-like floor.

An embodiment of a sliding gate valve designed in accordance with the invention is explained below in greater detail with the accompanying drawings, wherein only the parts of significance are show.

MODES FOR CARRYING OUT THE INVENTION

Figure 1:
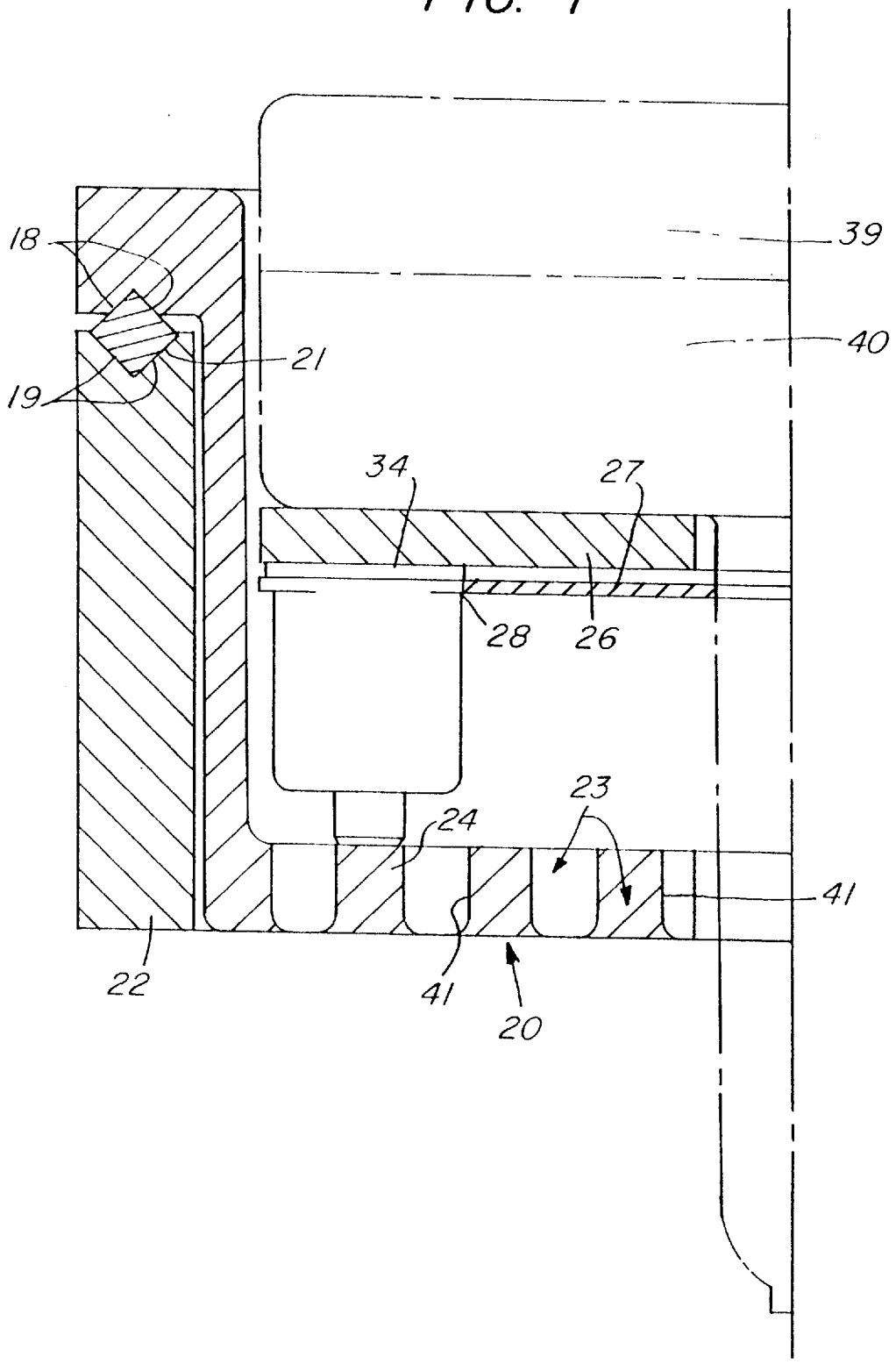
FIG. 1 A longitudinal section of the significant part of a sliding gate valve designed in accordance with the invention.
Figure 2:
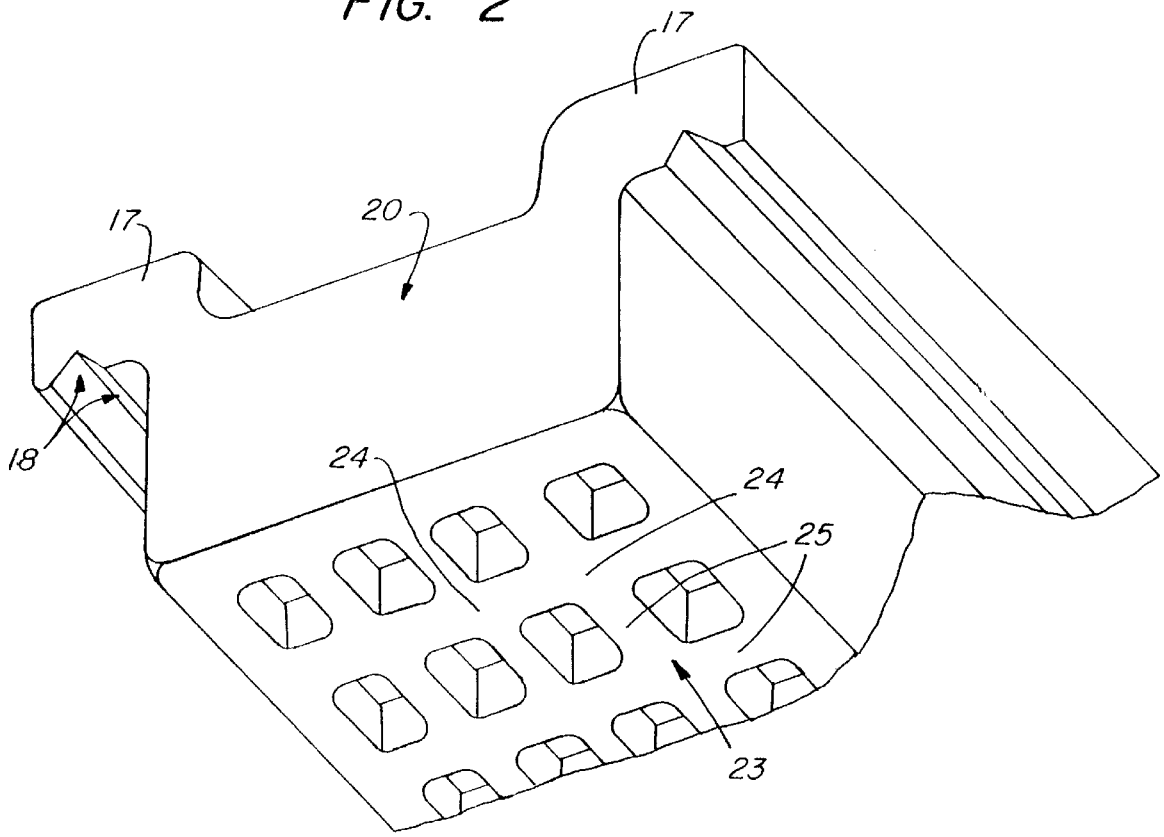
FIG. 2 a perspective underside view of part of the trough-like slide frame.

FIG. 1 and 2 clearly show that the slide frame, in which the sliding valve plate 40 is positioned, is designed to be in the shape of a trough of which the upper longitudinal edges 17 protrude laterally to the outside and have on their lower sides slide surfaces 18 that correspond to the slide surfaces 19 on the chamber during operation. In FIG. 1 and 2 the trough-like slide frame is marked no. 20. Moreover, in the depicted embodiment, the slide surfaces 18 and 19 both are shown as V-shaped grooves between which is arranged a slide bar 21 having a roughly square profile. In a preferred embodiment, this slide bar is made of an easily gliding material, e.g., bronze.

Figure 5:
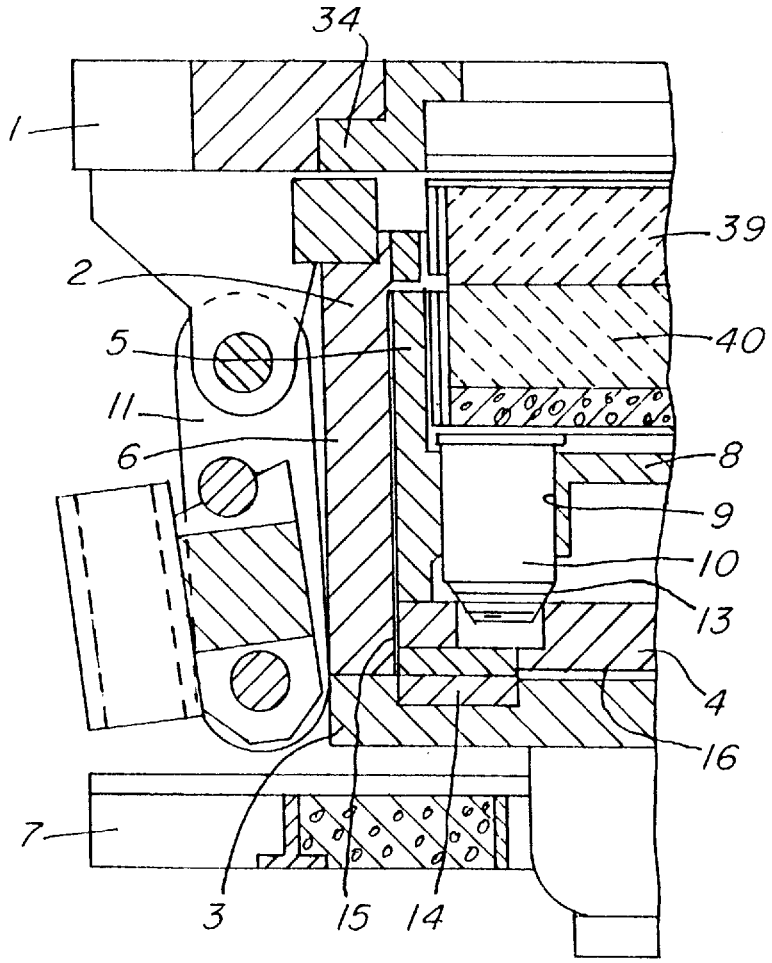
FIG. 5 PRIOR ART
FIG. 5 a longitudinal section of part of a convention pouring ladle valve.

It is of course just as conceivable and, in fact, even more preferable in terms of production, to provide the slide surfaces 18, 19 in the form of ribbon-like slide rails similar to the slide rails known in the state-of-the-art. In this case, the slide areas 18 in the slide frame are determined by slide rails arranged on the lower sides of the laterally protruding longitudinal edges, while the slide areas 19 on the chamber are defined by slide rails arranged on the opposite upper side of the chamber 22. In the embodiment depicted in FIG. 1, the chamber 22 is reduced to an oblong-shaped box profile. A floor plate for the chamber is not necessary. In addition, the most preferred specific embodiment does not have a separate floor plate for the slide frame as the slide frame is manufactured as a single-piece cast steel part. As shown particularly well in FIG. 2, the floor 23 of the trough-like slide frame 20 is designed in the manner of a segment grid. The spring elements 10 through which the sliding valve plate 40 is pressed against the stationary top plate 39 during operation, are supported on the slide frame by the intersection 24 of the segments 25 defining the grid-like floor 23. This means it is not necessary to have support plates associated with the spring elements as, e.g., in the way they are required for the state-of-the-art in accordance with FIG. 5. A pressure plate 26 is arranged between the sliding valve plate 40 and the spring elements 10 which press the pressure plate and sliding valve plate against the stationary top plate 39. The spring elements 10 are supported on the sliding-plate side of the pressure plate. The spring elements thus bear the pressure plate 26 and the floor 23 of the trough-like slide frame 20.

Also of particular significance is the fact that the spring elements 10 are held in position by a perforated plate 27 extending parallel to the floor 23 of the trough-like slide frame 20 or parallel to the sliding valve plate 40 or even parallel to the pressure plate 26. The spring elements 10 can be held in a clamp-like manner in the apertures 28 of the perforated plate 27 in such a way that the spring elements 10 can be mounted, removed or replaced together with the perforated plate 27 as one unit without the risk of them falling out of the perforated plate or the apertures 28.

The assembly unit "perforated plate 27/spring elements 10" is particularly easy to manage. Perforated plates can be prepared with any arrangement of holes, which can be replaced if necessary with the corresponding arrangement of spring elements. The apertures 28 of the perforated plate 27 are of course always associated with intersections 24 in the floor 23 of the slide frame 20.

In the embodiment shown, the perforated plate 27 extends at only a slight distance from and parallel to the pressure plate 26.

In order to avoid even the slightest risk of clogging of the slide surfaces 18 and 19 between the slide frame 20 and the chamber 22 by tar or another substance, the said slide surfaces lie at approximately the same level as the sliding valve plate 40, and—as already mentioned—outside of the slide frame 20. The tar that is unavoidably deposited from the refractory material of the top and/or sliding valve plate during operation can leak out or drop down through the apertures 28 in the floor 23 of the slide frame 20. The floor apertures 28 are defined between the floor segments 25.

Figure 3:
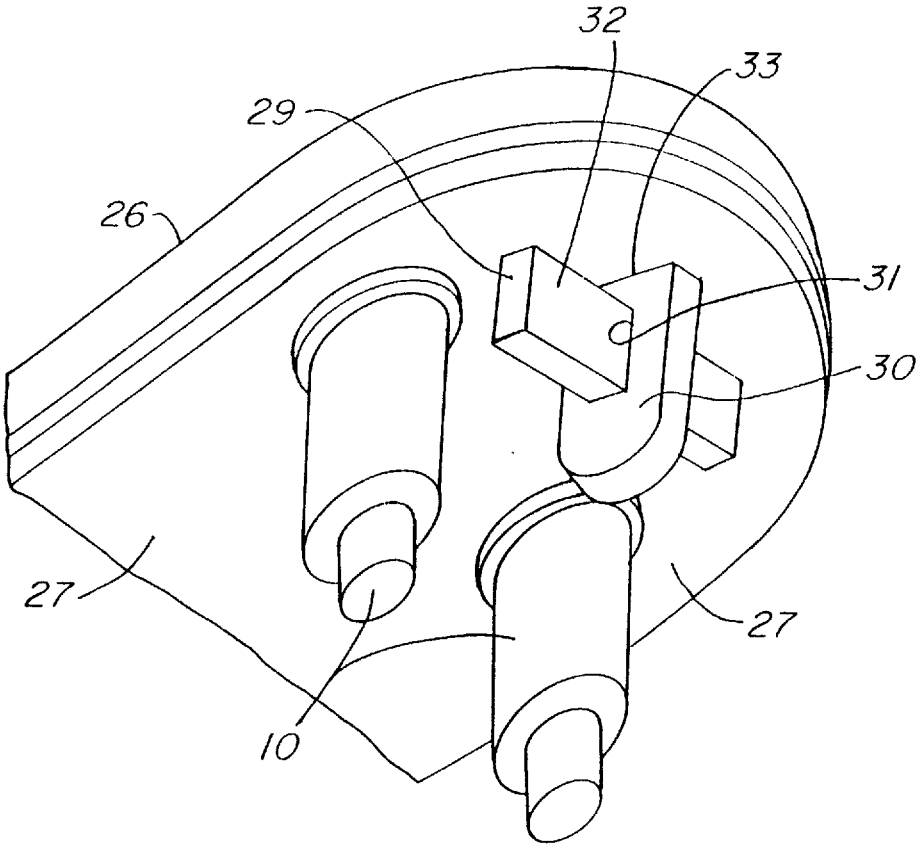
FIG. 3 a perspective partial underside view of the relative arrangement of the spring elements, perforated plate and pressure plate.

In accordance with FIG. 3 the perforated plate 27 can be held in position in relation to the pressure plate 26 by means of a wedge lock 29. This is defined by a clip 30 arranged on the lower side of the pressure plate 26, said clip 30 having both a transverse aperture 31 and also a wedge 32 that can be inserted into the traverse aperture 31. In the mounted position, the clip 30 extends through a corresponding aperture 33 in the perforated plate 27 in relation to the pressure plate 26 in a clamp-like manner. The distance between the perforated plate 27 and the pressure plate 26 is defined by a radially protruding circular rim 34 on the side of the spring elements 10 facing the sliding valve plate 40. The diameter of this circular rim 34 is greater than the inner diameter of the apertures 28 in the perforated plate 26 associated with the spring elements 10. In the mounted position, the circular rim 34 extends between the perforated plate 27 and the pressure plate 26 as shown in FIG. 1. The perforated plate 27 is pressed against the circular rims 34 of the spring elements by means of the flat wedge 32 and is thereby held away from the pressure plate 26 at a distance that is determined by the height of the circular rims 34. In the preferred embodiment, two wedge locks 29 of the type described are used, one at each end of the perforated plate 27.

In place of the described wedge lock, a screw connection between the perforated plate 27 and the pressure plate 26 is also possible. Furthermore, pure steel spring packets, such as helical springs, disk springs or thermodynamic springs may be used as spring elements.

Figure 4:
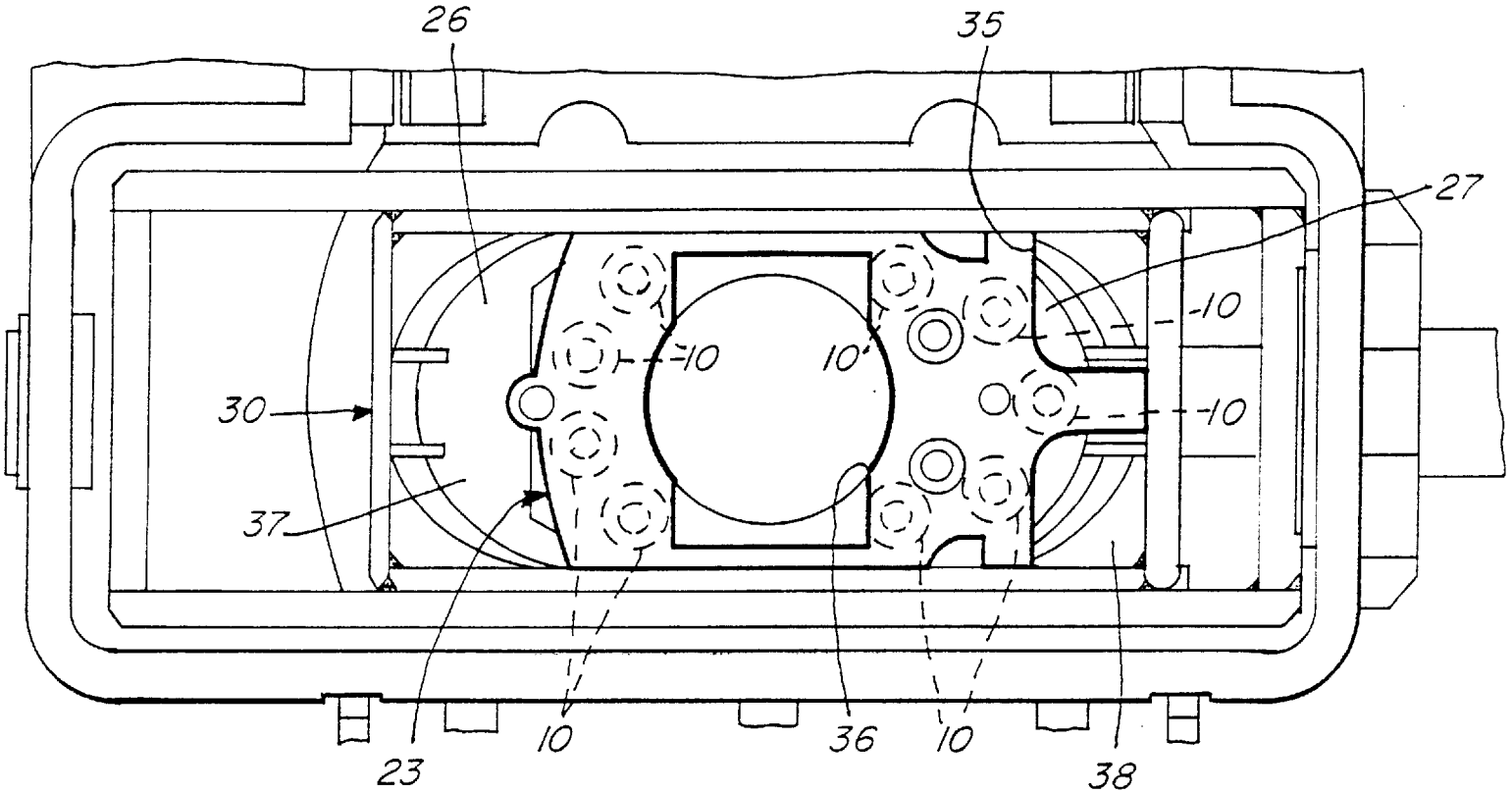
FIG. 4 an underside view of an alternative embodiment of the sliding gate valve in accordance with the invention.

FIG. 4 shows a view of the underside of a sliding gate valve, wherein parts already depicted in previous drawings have been given the same reference numbers in FIG. 4. This embodiment differs from the structure described in that, first, the slide frame 20 is a steel plate weldment, and secondly, the floor 23 of the slide frame is defined by the floor area only in the region where the spring elements 10 provide slide-frame-side support for the covering support segments or segmente plate 35. This plate has a central window 36 in which area there are no spring elements 10. The other areas 37, 38 of the floor where no spring elements 10 are effective is also open, in order to allow tar, etc. to fall directly below.

We claim:

1. A sliding gate valve which comprises a chamber (22), a stationary refractory plate (39) and a sliding refractory plate (40) moveable in relation to said stationary plate (39), said sliding plate (40) being supported within a slide frame (20) that is movable in relation to chamber (22), and spring elements (10) for pressing sliding plate (40) against the stationary plate (39), said slide frame (20) having a shape in the form of a trough of which the upper longitudinal edges (17) protrude laterally outwardly and serve as slide surfaces (18), said chamber having corresponding slide surfaces (19) mateable with the slide surfaces (18) of said frame (20).

2. A sliding gate valve in accordance with claim 1, wherein a floor (23) of the slide frame (20) has supporting segments for the spring elements (10), the area between the supporting segments as well as the area between the supporting segments and the outer edge of the floor being open spaces.

3. A sliding gate valve in accordance with claim 2, wherein the floor (23) of the slide frame (20) is in the form of a grid section.

4. A sliding gate valve in accordance with claim 3, wherein the spring elements (10) are supported on the slide frame (20) by the intersection (24) of the sections (25) defining the floor (23).

5. A sliding gate valve in accordance with claim 1, wherein a pressure plate (26) is arranged between the sliding refractory plate (40) the spring elements (10) press said sliding plate against the stationary plate (39) and said spring elements (10) being supported on the sliding plate side of the pressure plate (26).

6. A sliding gate valve in accordance with claim 1, characterized by the fact that the slide surfaces (18, 19) between the slide frame (20) and the chamber (22) lie at approximately the level of the sliding plate (40).

7. A sliding gate valve in accordance with claim 6, characterized by the fact that the slide surfaces (18, 19) of the slide frame (20) and of the chamber (22) that correspond to each other have a profile selected from the group consisting of trapezoids, semi-circular or V-shape.

8. A sliding gate valve in accordance with claim 6, characterized by the fact that a slide bar (21) having a circular profile matching the profile of the associated slide surfaces is arranged between the slide surfaces (18, 19) on the slide frame and on the chamber.

9. A sliding gate valve in accordance with claim 1, characterized by the fact that the slide frame (20) is a single-piece cast steel part.

10. A sliding gate valve comprising a chamber (22), a stationary refractory plate (39) and a sliding refractory plate (40) movable with respect to said stationary plate (39), said sliding plate (40) being supported within a slide frame (20) that is movable in relation to chamber (22), and spring elements for pressing sliding plate (40) against the stationary plate (39), the spring elements (10) being held in position by a perforated plate (27) extending parallel to a floor (23) of the frame (20).

11. A sliding gate valve in accordance with claim 10 wherein the spring elements (10) are secured in the apertures (28) of the perforated plate (27) so that the spring elements (10) together with the perforated plate (27) can be mounted, removed or replaced as one component unit.

12. A sliding gate valve in accordance with claim 11 wherein the perforated plate (27) extends close to and parallel to the pressure plate (26).

13. A sliding gate valve in accordance with claim 10, wherein the slide frame (20) has a shape in the form of a trough of which the upper longitudinal edges (17) protrude laterally outwardly and serve as slide surfaces (18) and in which said chamber (22) has corresponding slide surfaces (19) mateable with slide surfaces (18) of said frame (20).

* * * * *